US008003560B2

(12) United States Patent
Fujino et al.

(10) Patent No.: US 8,003,560 B2
(45) Date of Patent: Aug. 23, 2011

(54) HEAT-SENSITIVE RECORDING MATERIAL AND PROCESS FOR PRODUCTION THEREOF

(75) Inventors: Masatoshi Fujino, Amagasaki (JP); Haruo Omura, Amagasaki (JP); Kenji Muto, Amagasaki (JP)

(73) Assignee: Oji Paper Co., Ltd., Tokyo (JP)

( * ) Notice: Subject to any disclaimer, the term of this patent is extended or adjusted under 35 U.S.C. 154(b) by 162 days.

(21) Appl. No.: 12/530,658

(22) PCT Filed: Mar. 28, 2008

(86) PCT No.: PCT/JP2008/056161

§ 371 (c)(1),
(2), (4) Date: Sep. 10, 2009

(87) PCT Pub. No.: WO2008/120740

PCT Pub. Date: Oct. 9, 2008

(65) Prior Publication Data

US 2010/0087317 A1 Apr. 8, 2010

(30) Foreign Application Priority Data

| | | |
|---|---|---|
| Mar. 30, 2007 | (JP) | 2007-091878 |
| Jul. 2, 2007 | (JP) | 2007-173916 |
| Mar. 3, 2008 | (JP) | 2008-051634 |

(51) Int. Cl.
*B41M 5/30* (2006.01)

(52) U.S. Cl. ..... 502/213; 427/150; 427/180

(58) Field of Classification Search ..... None
See application file for complete search history.

(56) References Cited

U.S. PATENT DOCUMENTS

| | | | |
|---|---|---|---|
| 4,644,376 | A | 2/1987 | Usami |
| 5,804,528 | A | 9/1998 | Aoki |

FOREIGN PATENT DOCUMENTS

| | | | |
|---|---|---|---|
| JP | 4-4960 | | 1/1992 |
| JP | 4-37796 | | 6/1992 |
| JP | 4-37797 | | 6/1992 |
| JP | 5-63315 | | 9/1993 |
| JP | 11-78246 | | 3/1999 |
| JP | 3085187 | | 7/2000 |
| JP | 2003-127550 | A1 | 5/2003 |
| JP | 3446553 | | 7/2003 |
| JP | 2003-251939 | A1 | 9/2003 |
| JP | 2004-216241 | A1 | 8/2004 |

OTHER PUBLICATIONS

International Search Report for International Application No. PCT/JP2008/056161 dated May 14, 2008.

*Primary Examiner* — Bruce H Hess
(74) *Attorney, Agent, or Firm* — Kratz, Quintos & Hanson, LLP

(57) ABSTRACT

Disclosed is a heat-sensitive recording material comprising a support and a heat-sensitive recording layer formed on the support, the heat-sensitive recording layer containing dye precursor-containing composite particles and a developer, the dye precursor-containing composite particles being obtained by dissolving a solute containing a dye precursor in a solvent containing a polyvalent isocyanate compound-containing polymerization component, emulsifying and dispersing the obtained solution in an aqueous medium, and then performing a polymerization reaction of the polyvalent isocyanate compound-containing polymerization component in the presence of polyethyleneimine having a molecular weight of 200 to 1,500. Also disclosed is a method of producing such a heat-sensitive recording material.

15 Claims, No Drawings

HEAT-SENSITIVE RECORDING MATERIAL AND PROCESS FOR PRODUCTION THEREOF

TECHNICAL FIELD

The present invention relates to a heat-sensitive recording material comprising a dye precursor in the form of composite particles that contain the dye precursor, and particularly relates to a heat-sensitive recording material that ensures high heat resistance, generation of a very small degree of background fogging, and excellent recording sensitivity.

BACKGROUND ART

Heat-sensitive recording materials that make use of the color-forming reaction of a dye precursor with a developer, in which both coloring materials are melted and brought into contact with each other by heating to produce a color image, are well known. Such heat-sensitive recording materials are relatively inexpensive, and recording devices for these materials are compact and easy to maintain. For these reasons, they are used in a broad range of fields, such as recording media for facsimiles, word processors, various computers, and other applications. However, conventionally used heat-sensitive recording materials comprising a developer and solid particles composed of a dye precursor are problematic in that color images thereon decolorize due to heat or humidity.

For the purpose of improving this defect, Patent Documents 1, 2, 3 and 4 propose heat-sensitive recording materials in which a dye precursor is contained in microcapsules. However, when such microcapsules containing an oily liquid prepared by dissolving a dye precursor in an organic solvent are applied to a heat-sensitive recording material, friction and pressure cause increased fogging, resulting in coloration of the background. This problem is effectively avoided by increasing the wall thickness of microcapsules; however this poses a problem that color sensitivity is reduced.

Further, Patent Document 5 proposes a heat-sensitive recording material using composite particles in which a dye precursor is contained in a matrix composed of polyurea or polyurethane resin, the matrix being obtained by dissolving a dye precursor in a solvent comprising a polyvalent isocyanate compound-containing polymerization component, emulsifying and dispersing the solution in a hydrophilic protective colloid-containing aqueous solution, and warming this emulsion. Although the heat-sensitive recording materials using such composite particles containing a dye precursor have a certain level of heat-resistant preservability, heat-sensitive recording materials free from background fogging even in a higher-temperature environment have increasingly been desired.

Moreover, Patent Document 6 proposes a heat-sensitive recording material using composite particles that are produced by emulsifying and dispersing a solution, wherein the solvent is a polyvalent isocyanate compound and the solute is a dye precursor, in a hydrophilic protective colloid-containing aqueous solution, and then accelerating a polymerization reaction of the polyvalent isocyanate compound, wherein a specific amount of a water-soluble aliphatic polyamine compound is added to the protective colloid solution. However, the heat-sensitive recording material using the thus-produced composite particles has been desired to suppress the generation of background fogging when exposed to a high-temperature environment.

Patent Document 1: Japanese Examined Patent Publication No. 1992-4960

Patent Document 2: Japanese Examined Patent Publication No. 1992-37796

Patent Document 3: Japanese Examined Patent Publication No. 1992-37797

Patent Document 4: Japanese Examined Patent Publication No. 1993-63315

Patent Document 5: Japanese Patent No. 3085187

Patent Document 6: Japanese Patent No. 3446553

DISCLOSURE OF THE INVENTION

Problems to be Solved by the Invention

An object of the present invention is to provide a heat-sensitive recording material that undergoes a very small degree of background fogging and, even after exposure to a high-temperature environment, ensures sufficient heat resistance and undergoes a very small degree of background fogging, while exhibiting excellent recording sensitivity.

Means for Solving the Problem

The present inventors carried out intensive research to obtain a heat-sensitive recording material with high heat resistance, particularly focusing on the improvement of dye precursor-containing composite particles. As a result, the inventors found that heat resistance is remarkably improved through the use of polyethyleneimine as a reaction accelerator during the production of dye precursor-containing composite particles.

The present invention has been accomplished based on this finding and further research, and provides heat-sensitive recording materials as set forth below:

Item 1. A heat-sensitive recording material comprising a support and a heat-sensitive recording layer formed on the support, the heat-sensitive recording layer containing dye precursor-containing composite particles and a developer, the dye precursor-containing composite particles being obtained by dissolving a solute comprising a dye precursor in a solvent comprising a polyvalent isocyanate compound-containing polymerization component, emulsifying and dispersing the obtained solution in an aqueous medium, and then performing a polymerization reaction of the polyvalent isocyanate compound-containing polymerization component in the presence of polyethyleneimine having a molecular weight of 200 to 1,500.

Item 2. The heat-sensitive recording material according to Item 1, wherein the polyethyleneimine has a molecular weight of 200 to 1,300.

Item 3. The heat-sensitive recording material according to Item 1 or 2, wherein the polyethyleneimine has a branched structure containing primary, secondary, and tertiary amines.

Item 4. The heat-sensitive recording material according to any one of Items 1 to 3, wherein the polyethyleneimine is used in an amount of 1 to 20 mass % based on the polyvalent isocyanate compound-containing polymerization component.

Item 5. The heat-sensitive recording material according to any one of Items 1 to 4, wherein the polyvalent isocyanate compound-containing polymerization component is dicyclohexylmethane-4,4'-diisocyanate.

Item 6. The heat-sensitive recording material according to any one of Items 1 to 4, wherein the polyvalent isocyanate compound-containing polymerization component is dicyclohexylmethane-4,4'-diisocyanate and m-tetramethylxylylene diisocyanate.

Item 7. The heat-sensitive recording material according to any one of Items 1 to 4, wherein the polyvalent isocyanate compound-containing polymerization component is an isocyanurate of hexamethylene diisocyanate, and m-tetramethylxylylene diisocyanate.

Item 8. The heat-sensitive recording material according to any one of Items 1 to 7, further comprising a protective layer on the heat-sensitive recording layer.

Item 9. A method of producing a heat-sensitive recording material, comprising the steps of:

(a) producing dye precursor-containing composite particles by dissolving a solute comprising a dye precursor in a solvent comprising a polyvalent isocyanate compound-containing polymerization component, emulsifying and dispersing the obtained solution in an aqueous medium, and then performing a polymerization reaction of the polyvalent isocyanate compound-containing polymerization component in the presence of polyethyleneimine having a molecular weight of 200 to 1,500;

(b) preparing a heat-sensitive recording layer coating composition comprising the obtained dye precursor-containing composite particles, a developer, and a binder; and (c) applying the obtained heat-sensitive recording layer coating composition to a support and drying the resulting coating.

Item 10. The method according to Item 9, wherein the polyethyleneimine has a molecular weight of 200 to 1,300.

Item 11. The method according to Item 9 or 10, wherein the polyethyleneimine has a branched structure containing primary, secondary, and tertiary amines.

Item 12. The method according to any one of Items 9 to 11, wherein the polyethyleneimine is used in an amount of 1 to 20 mass % based on the polyvalent isocyanate compound-containing polymerization component.

Item 13. The method according to any one of Items 9 to 12, wherein the polyvalent isocyanate compound-containing polymerization component is dicyclohexylmethane-4,4'-diisocyanate.

Item 14. The method according to any one of Items 9 to 12, wherein the polyvalent isocyanate compound-containing polymerization component is dicyclohexylmethane-4,4'-diisocyanate and m-tetramethylxylylene diisocyanate.

Item 15. The method according to any one of Items 9 to 12, wherein the polyvalent isocyanate compound-containing polymerization component is an isocyanurate of hexamethylene diisocyanate, and m-tetramethylxylylene diisocyanate.

Item 16. The method according to any one of Items 9 to 15, wherein the solution of the solute comprising a dye precursor in the solvent comprising a polyvalent isocyanate compound-containing polymerization component further comprises a low-boiling solvent selected from the group consisting of ethyl acetate, butyl acetate, and methylene chloride.

Item 17. The method according to any one of Items 9 to 16, wherein a protective layer is further formed on a heat-sensitive recording layer.

Item 18. A method of producing dye precursor-containing composite particles, the method comprising dissolving a solute containing a dye precursor in a solvent containing a polyvalent isocyanate compound-containing polymerization component, emulsifying and dispersing the obtained solution in an aqueous medium, and performing a polymerization reaction of the polyvalent isocyanate compound-containing polymerization component in the presence of polyethyleneimine having a molecular weight of 200 to 1,500.

Item 19. The heat-sensitive recording material according to any one of Items 1 to 8, wherein the composite particles have a mean particle diameter of 0.5 to 3.0 μm.

Effect of the Invention

The heat-sensitive recording material according to the present invention has advantages including the generation of a very small degree of background fogging, remarkably improved heat resistance, the generation of a very small degree of background fogging even upon exposure to a high-temperature environment, and excellent recording sensitivity, ensuring a high recording density.

BEST MODE FOR CARRYING OUT THE INVENTION

The dye precursor-containing composite particles (hereinafter simply referred to as "composite particles") used in the heat-sensitive recording material of the present invention is obtained by emulsifying and dispersing in an aqueous medium a solution of a dye precursor in a polyvalent isocyanate compound-containing polymerization component, and then performing a polymerization reaction of the polyvalent isocyanate compound-containing polymerization component in the presence of polyethyleneimine having a molecular weight of 200 to 1,500.

Polyethyleneimine

When the molecular weight of the polyethyleneimine is in the above range, a satisfactory heat-resistance improvement effect can be exhibited, and a reduction in recording sensitivity accompanying heat-resistance improvement can be minimized, thereby attaining a heat-sensitive recording material that is also excellent in recording sensitivity. However, when the molecular weight of polyethyleneimine exceeds 1,500, although the heat-resistance improvement effect can be obtained, the recording sensitivity is significantly reduced. Therefore, such a polyethyleneimine is not preferable for the present invention.

The molecular weight defined herein is a number average molecular weight according to an ebullioscopic method.

In the present invention, the molecular weight of polyethyleneimine is preferably about 200 to about 1,300, and more preferably about 300 to about 1,200. When the molecular weight of polyethyleneimine is less than 400, reactivity with a polyvalent isocyanate compound-containing polymerization component is high, and therefore it tends to be difficult to control the polymerization reaction of the polymerization component. Further, formation of bubbles due to generated carbon dioxide is likely to become significant. Therefore, in consideration of ease of production of composite particles, it is desirable to use polyethyleneimine with a molecular weight of 400 or more. When polyethyleneimine with a molecular weight of 400 or more is used, composite particles with stable quality are easily produced, which results in heat-sensitive recording materials more excellent in recording sensitivity stability. Accordingly, the molecular weight of polyethyleneimine may be generally about 400 to about 1,500, preferably about 400 to about 1,300, and more preferably about 400 to about 1,200.

As the polyethyleneimine that is used as a reaction accelerator for polymerizing a polyvalent isocyanate compound-containing polymerization component, any commercially available products can be used; for example, a typical linear polymer compound may be used.

However, among various polyethyleneimines, the use of a branched polyethyleneimine having a primary, secondary, and tertiary amines can afford composite particles having remarkably improved heat resistance and an excellent property (hereinafter referred to as a "isolation property") of inhibiting the contact between a dye precursor in the composite particles and a developer outside the composite particles under no heating. As a result, the background fogging of the heat-sensitive recording material formed of such composite particles is reduced, and the heat resistance is remarkably improved, ensuring a heat-sensitive recording material having extremely reduced background fogging even when exposed to high temperature environment, and exhibiting excellent recording sensitivity. Therefore, such a polyethyleneimine is particularly preferable.

Examples of branched polyethyleneimines having a primary, secondary, and tertiary amines include those commercially available under the trade name "EPOMIN" from Nippon Shokubai Co., Ltd., those commercially available under the trade name "Lupasol" from BASF Japan Ltd, etc. For use, however, polyethyleneimines must be selected from those having the aforementioned range of molecular weight.

In the present invention, as described above, although the polymerization reaction of the polyvalent isocyanate compound-containing polymerization component is performed in the presence of polyethyleneimine with a specific molecular weight, reaction accelerators other than polyethyleneimine, e.g., tin compounds, polyamide compounds, epoxy compounds, polyamine compounds, etc. can be also added to an aqueous medium as long as the effect of the invention is not impaired.

Polyvalent Isocyanate Compound-Containing Polymerization Component

The polyvalent isocyanate compound-containing polymerization component used in the preparation of the composite particles of the present invention is a compound that forms polyurea or polyurea-polyurethane by reacting with water, and may be a single polyvalent isocyanate compound, or a mixture of a polyvalent isocyanate compound and a polyol that reacts therewith, an adduct of a polyol and a polyvalent isocyanate compound, or a multimer such as a biuret or an isocyanurate of polyvalent isocyanate.

Examples of polyvalent isocyanate compounds used in the present invention include m-phenylene diisocyanate, p-phenylene diisocyanate, 2,6-tolylenediisocyanate, 2,4-tolylenediisocyanate, naphthalene-1,4-diisocyanate, diphenylmethane-4,4'-diisocyanate, dicyclohexylmethane-4,4'-diisocyanate, 5-isocyanate-1-(isocyanatemethyl)-1,3,3-trimethylcyclohexane, 3,3'-dimethyldiphenylmethane-4,4'-diisocyanate, xylylene-1,4-diisocyanate, m-tetramethylxylylene diisocyanate, 4,4'-diphenylpropanediisocyanate, trimethylene diisocyanate, hexamethylene diisocyanate, propylene-1,2-diisocyanate, butylene-1,2-diisocyanate, cyclohexylene-1,2-diisocyanate, cyclohexylene-1,4-diisocyanate, and like diisocyanates; 4,4',4"-triphenylmethanetriisocyanate, toluene-2,4,6-triisocyanate, and like triisocyanates; 4,4'-dimethyldiphenylmethane-2,2',5,5'-tetraisocyanate and like tetraisocyanates.

Examples of adducts of a polyvalent isocyanate compound and a polyol include a trimethylolpropane adduct of hexamethylene diisocyanate, a trimethylolpropane adduct of 2,4-tolylenediisocyanate, a trimethylolpropane adduct of xylylene diisocyanate, a hexanetriol adduct of tolylene diisocyanate, and like isocyanate prepolymers.

Examples of multimers of polyvalent isocyanate compounds include a biuret of hexamethylene diisocyanate, an isocyanurate of hexamethylene diisocyanate, etc.

Examples of polyol compounds used in the present invention include ethylene glycol, 1,3-propanediol, 1,4-butanediol, 1,5-pentanediol, 1,6-hexanediol, 1,7-heptanediol, 1,8-octanediol, propylene glycol, 2,3-dihydroxybutane, 1,2-dihydroxybutane, 1,3-dihydroxybutane, 2,2-dimethyl-1,3-propanediol, 2,4-pentanediol, 2,5-hexanediol, 3-methyl-1,5-pentanediol, 1,4-cyclohexane dimethanol, dihydroxycyclohexane, diethylene glycol, 1,2,6-trihydroxy hexane, 1,1,1-trimethylolpropane, hexanetriol, pentaerythritol, glycerin, and like aliphatic polyols; 1,4-di(2-hydroxyethoxy)benzene, 1,3-di(2-hydroxyethoxy)benzene, and like condensation products of aromatic polyhydric alcohol and alkylene oxide;

phenylethylene glycol, p-xylylene glycol, m-xylylene glycol, $\alpha,\alpha'$-dihydroxy-p-diisopropylbenzene, 4,4'-dihydroxydiphenylmethane, 2-(p,p'-dihydroxydiphenyl methyl)benzyl alcohol, 4,4'-isopropylidenediphenol, 4,4'-dihydroxydiphenylsulfone, 4,4'-dihydroxydiphenyl sulfide, and like aromatic polyols; an ethylene oxide adduct of 4,4'-isopropylidenediphenol, a propylene oxide adduct of 4,4'-isopropylidenediphenol, acrylate having a hydroxy group in a molecule such as 2-hydroxy acrylate, etc.

When a polyol compound is used, the amount thereof can be selected from a wide range, but may be generally about 5 to about 100 parts by mass, and particularly about 10 to about 50 parts by mass, relative to 100 parts by mass of the polyvalent isocyanate compound.

It is obvious that polyvalent isocyanate compounds, adducts of a polyvalent isocyanate and a polyol, polyol compounds, etc., are not limited to the aforementioned examples, and a mixture of at least two of them may be used, as necessary.

In the present invention, to produce composite particles having an improved isolation property and heat resistance, it is preferable to use dicyclohexylmethane 4,4'-diisocyanate alone as polyvalent isocyanate compound-containing polymerization component.

Further, to obtain composite particles having improved recording sensitivity while minimizing the reduction in heat resistance, it is preferable to use dicyclohexylmethane-4,4'-diisocyanate in combination with m-tetramethylxylylene diisocyanate. In this case, m-tetramethylxylylene diisocyanate is preferably used in an amount of about 50 to about 200 parts by mass, and more preferably about 75 to about 175 parts by mass, relative to 100 parts by mass of dicyclohexylmethane-4,4'-diisocyanate.

Similarly, to obtain composite particles having further improved recording sensitivity while suppressing the reduction in heat resistance, m-tetramethylxylylene diisocyanate is used in combination with an isocyanurate of hexamethylene diisocyanate as polyvalent isocyanate compound-containing polymerization component. In this case, it is desirable that the isocyanurate of a hexamethylene diisocyanate be used in an amount of about 10 to about 50 parts by mass, and preferably about 20 to about 40 parts by mass, relative to 100 parts by mass of the m-tetramethylxylylene diisocyanate.

Dye Precursor

Dye precursors used in the present invention are not particularly limited, and include triaryl-based, diphenylmethane-based, thiazine-based, spiro-based, lactam-based, and fluoran-based leuco compounds.

Specifically, examples of dye precursors providing black color include 3-pyrrolidino-6-methyl-7-anilinofluoran, 3-diethylamino-7-(m-trifluoromethylanilino)fluoran, 3-(N-isoamyl-N-ethylamino)-7-(o-chloroanilino)fluoran, 3-(N-ethyl-p-toluidino)-6-methyl-7-anilinofluoran, 3-(N-ethyl-N-2-tetrahydrofurfurylamino)-6-methyl-7-anilinofluoran, 3-diethylamino-6-chloro-7-anilinofluoran, 3-di(n-butyl)amino-6-methyl-7-anilinofluoran, 3-di(n-amyl)amino-6-methyl-7-anilinofluoran, 3-(N-ethyl-N-isoamylamino)-6-methyl-7-anilinofluoran, 3-(N-n-hexyl-N-ethylamino)-6-methyl-7-anilinofluoran, 3-[N-(3-ethoxypropyl)-N-ethylamino]-6-methyl-7-anilinofluoran, 3-[N-(3-ethoxypropyl)-N-methylamino]-6-methyl-7-anilinofluoran, 3-diethylamino-7-(2-chloroanilino)fluoran, 3-di(n-butyl)amino-7-(2-chloroanilino)fluoran, 3-diethylamino-6-methyl-7-anilinofluoran, 3-diethylamino-6-methyl-7-(2,6-dimethylanilino)fluoran, 3-diethylamino-6-methyl-7-(2,4-dimethylanilino)fluoran, 2,4-dimethyl-6-(4-dimethylaminoanilino)fluoran, 3-(N-cyclohexyl-N-methylamino)-6-methyl-7-anilinofluoran, 3-diethylamino-6-methyl-7-(3-toluidino)fluoran, etc.

Of the aforementioned dye precursors providing black color, 3-di(n-butyl)amino-6-methyl-7-anilinofluoran, 3-di(n-amyl)amino-6-methyl-7-anilinofluoran, 3-diethylamino-6-methyl-7-(2,6-dimethylanilino)fluoran, 3-diethylamino-6-methyl-7-(2,4-dimethylanilino)fluoran, 2,4-dimethyl-6-(4-dimethylaminoanilino)fluoran, and 3-(N-ethyl-p-toluidino)-6-methyl-7-anilinofluoran are preferable since they suppress background fogging. To increase recording density, the use of 3-(N-ethyl-N-isoamylamino)-6-methyl-7-anilinofluoran is also effective.

Examples of dye precursors providing red, red-violet, or orange color include 3,6-bis(diethylamino)fluoran-γ-anilinolactam, 3,6-bis(diethylamino)fluoran-γ-(p-nitro)anilinolactam, 3,6-bis(diethylamino)fluoran-γ-(o-chloro)anilinolactam, 3-dimethylamino-7-bromofluoran, 3-diethylaminofluoran, 3-diethylamino-6-methylfluoran, 3-diethylamino-7-methylfluoran, 3-diethylamino-7-chlorofluoran, 3-diethylamino-7-bromofluoran, 3-diethylamino-7,8-benzofluoran, 3-diethylamino-6,8-dimethylfluoran, 3-diethylamino-6-methyl-7-chlorofluoran, 3-diethylamino-7-tert-butylfluoran, 3-(N-ethyl-N-tolylamino)-7-methylfluoran, 3-(N-ethyl-N-tolylamino)-7-ethylfluoran, 3-(N-ethyl-N-isobutylamino)-6-methyl-7-chlorofluoran, 3-(N-ethyl-N-isoamylamino)-7,8-benzofluoran, etc.

Further examples of dye precursors providing red, red-violet, or orange color include 3-cyclohexylamino-6-chlorofluoran, 3-di-n-butylamino-6-methyl-7-bromofluoran, 3-di-n-butylamino-7,8-benzofluoran, 3-tolylamino-7-methylfluoran, 3-tolylamino-7-ethylfluoran, 2-(N-acetyl anilino)-3-methyl-6-di-n-butylamino fluoran, 2-(N-propionyl anilino)-3-methyl-6-di-n-butylamino fluoran, 2-(N-benzoylanilino)-3-methyl-6-di-n-butylamino fluoran, 2-(N-carbo butoxyanilino)-3-methyl-6-di-n-butylamino fluoran, 2-(N-formylanilino)-3-methyl-6-di-n-butylamino fluoran, 2-(N-benzylanilino)-3-methyl-6-di-n-butylamino fluoran, 2-(N-allylanilino)-3-methyl-6-di-n-butylamino fluoran, and 2-(N-methylanilino)-3-methyl-6-di-n-butylamino fluoran.

Examples of dye precursors providing red, red-violet, and orange color still further include 3,3'-bis(1-n-butyl-2-methylindol-3-yl)phthalide, 3,3'-bis(1-ethyl-2-methylindol-3-yl)phthalide, 3,3'-bis(1-n-octyl-2-methylindol-3-yl)phthalide, 7-(N-ethyl-N-isoamylamino)-3-methyl-1-phenylspiro[(1,4-dihydrochromeno[2,3-c]pyrazole)-4,3'-phthalide], 7-(N-ethyl-N-isoamylamino)-3-methyl-1-p-methylphenylspiro[(1,4-dihydrochromeno[2,3-c]pyrazole)-4,3'-phthalide], 7-(N-ethyl-N-n-hexylamino)-3-methyl-1-phenylspiro[(1,4-dihydrochromeno[2,3-c]pyrazole)-4,3'-phthalide], etc.

Of these compounds, from the viewpoint of high coloring sensitivity and less background fogging, preferable examples of dye precursors providing red color include 3-diethylamino-7-chlorofluoran and 3-diethylamino-6-methyl-7-chlorofluoran; preferable examples of dye precursors providing orange color include 3-cyclohexylamino-6-chlorofluoran, 3-diethylamino-6,8-dimethylfluoran, and 7-(N-ethyl-N-isoamylamino)-3-methyl-1-phenylspiro-[(1,4-dihydrochromeno[2,3-c]pyrazole)-4,3'-phthalide]; and preferable examples of dye precursors providing red-violet color include 3,3'-bis(1-n-butyl-2-methylindol-3-yl)phthalide.

Examples of precursor dyes providing blue color include 3,3-bis(p-dimethylaminophenyl)-6-dimethylaminophthalide, 3-(4-diethylamino-2-methylphenyl)-3-(4-dimethylaminophenyl)-6-dimethylaminophthalide, 3-(1-ethyl-2-methylindol-3-yl)-3-(4-diethylaminophenyl)-phthalide, 3-(1-ethyl-2-methylindol-3-yl)-3-(2-methyl-4-diethylaminophenyl)-4-azaphthalide, 3-(1-ethyl-2-methylindol-3-yl)-3-(2-ethoxy-4-diethylaminophenyl)-4-azaphthalide, 3-(1-ethyl-2-methylindol-3-yl)-3-(2-n-hexyloxy-4-diethylaminophenyl)-4-azaphthalide, 3-diphenylamino-6-diphenylaminofluoran, etc. Of these blue color-forming dye precursors, 3-(4-diethylamino-2-methylphenyl)-3-(4-dimethylaminophenyl)-6-dimethylaminophthalide is preferable from the viewpoint of little background fogging.

Examples of dye precursors providing green color include 3-(N-ethyl-N-n-hexylamino)-7-anilinofluoran, 3-diethylamino-7-dibenzylaminofluoran, 3,3'-bis(4-diethylamino-2-ethoxyphenyl)-4-azaphthalide, 3-(N-ethyl-N-p-tolylamino)-7-(N-phenyl-N-methylamino)fluoran, 3-[p-(p-anilinoanilino)anilino]-6-methyl-7-chlorofluoran, 3,6-bis(dimethylamino)fluorene-9-spiro-3'-(6'-dimethylamino)-phthalide, etc. Of these dye precursors providing green color, 3,3'-bis(4-diethylamino-2-ethoxyphenyl)-4-azaphthalide is preferable from the viewpoint of little background fogging and good coloring sensitivity.

Examples of dye precursors providing yellow color include 3,6-dimethoxyfluoran, 1-(4-n-dodecyloxy-3-methoxyphenyl)-2-(2-quinolyl)ethylene, etc.

As necessary, any of such dye precursors can be used in combination with at least one dye precursor providing the same color tone, or a different color tone for tone adjustment.

Other Components that may be Used with a Dye Precursor

In the present invention, to further improve coloring sensitivity, an organic compound having a melting point of 40 to 150° C. and a boiling point of at least 200° C. can be used as a solute for producing composite particles, in addition to a dye precursor. Preferable examples of organic compounds having a melting point of 40° C. to 150° C. and a boiling point of at least 200° C. include aromatic ketone compounds, aromatic ether compounds, and aromatic cyclic ester compounds. Specifically, examples of aromatic ketone compounds include benzophenone; examples of aromatic ether compounds include 1,2-di(m-tolyloxy)ethane, 1,2-diphenoxyethane, 1-(4-methoxyphenoxy)-2-(2-methylphenoxy)ethane; and examples of aromatic cyclic ester compounds include coumarin, phthalide, etc. The above organic compounds may be used singly or in a combination of two or more.

In addition to a dye precursor, benzophenone-based (e.g., 2-hydroxy-4-octoxybenzophenone) or benzotriazole-based UV absorbers, antioxidants, oil-soluble fluorescent dyes, mold lubricants, organic tin compounds, and like reaction accelerators, etc. can be added as a solute for producing composite particles, if necessary.

Aqueous Medium

The aqueous medium used for emulsifying and dispersing a solution of a dye precursor in a polyvalent isocyanate compound-containing polymerization component contains water and an emulsifier (protective colloid solution). Examples of such emulsifiers include water-soluble synthetic polymers such as polyacrylamide, polyvinylpyrrolidone, polyvinyl alcohol, sulfone-modified polyvinyl alcohol, and like modified polyvinyl alcohols, methylcellulose, carboxymethyl cellulose, styrene/maleic anhydride copolymer salts, and derivatives thereof.

The solids content of an emulsifier in the aqueous medium is not particularly limited, but is generally about 2 to about 20 mass %, and preferably about 5 to about 15 mass %. As necessary, surfactants, anti-foaming agents, and the like may be added to the aqueous medium.

The amount of an emulsifier used in the preparation of composite particles is not particularly limited, but an aqueous medium is preferably used in an amount such that the amount of emulsifier is about 10 to about 50 mass %, and preferably about 15 to about 35 mass %, relative to a solution containing a polyvalent isocyanate compound-containing polymerization component and a dye precursor as main components.

Preparation of Composite Particles

In general, the dye precursor-containing composite particles of the present invention are prepared by dissolving a dye precursor-containing solute in a solvent containing a polyvalent isocyanate compound-containing polymerization component, emulsifying and dispersing the resulting solution in an aqueous medium, and then performing the polymerization reaction of the polyvalent isocyanate compound-containing polymerization component in the presence of polyethyleneimine having a molecular weight of 200 to 1,500.

From the viewpoint of coloring sensitivity and isolation property, the proportion of the dye precursor and the polyvalent isocyanate compound-containing polymerization component used in the preparation of composite particles is such that the amount of the polyvalent isocyanate compound-containing polymerization component is preferably about 50 to 500 parts by mass, and more preferably about 60 to about 200 parts by mass, relative to 100 parts by mass of the dye precursor.

Since the composite particles to be used in the present invention include, as a reaction accelerator, polyethyleneimine with a specific molecular weight, sufficient improvement effects in regards to isolation property and heat resistance can be attained compared to known composite particles, even when the amount of the polyvalent isocyanate compound-containing polymerization component is reduced to about 75%, thereby improving the recording sensitivity.

For the preparation of the composite particles to be used in the present invention, a solution containing a polyvalent isocyanate compound-containing polymerization component as a main solvent and a dye precursor as a solute is emulsified and dispersed in an aqueous medium; however, to reduce the viscosity of the solution, a low-boiling-point solvent can be used as an auxiliary solvent, if necessary. Examples of such low-boiling-point solvents include ethyl acetate, butyl acetate, methylene chloride, etc.

When such a low-boiling-point solvent is used, it is desirable that the amount thereof be about 0.1 to about 15 mass %, and preferably about 0.5 to 5 mass %, relative to the total amount of the polyvalent isocyanate compound-containing polymerization component and the low-boiling-point solvent.

In the present invention, heating at about 60 to about 200° C. may be optionally performed when the solute mainly comprising a dye precursor is dissolved in a solvent mainly comprising a polyvalent isocyanate compound-containing polymerization component.

The solution of a dye precursor in a polyvalent isocyanate compound-containing polymerization component is emulsified or dispersed in an aqueous medium according to a usual method using a known dispersion machine, such as a homogenizer, Cowles dispersion mixer, etc.

In the present invention, polyethyleneimine is essential for performing the polymerization reaction of a polyvalent isocyanate compound-containing polymerization component. For this reason, polyethyleneimine must be present in a dispersion in which a solution of a dye precursor in a polyvalent isocyanate compound-containing polymerization component is emulsified and dispersed in an aqueous medium.

Examples of methods for adding polyethyleneimine include (A) a method in which polyethyleneimine is added to an aqueous medium in advance, (B) a method in which polyethyleneimine is added to a dispersion formed by emulsification and dispersion, and (C) a method in which polyethyleneimine is added after commencement of the heating of an emulsion used for polymerization reaction. Any of such methods can be used; however, methods (B) and (C) are preferable, and method (C) is more preferable.

Polyethyleneimine used in the present invention is water-soluble. Therefore, it is present in a dissolved state in a continuous phase (aqueous medium phase) that forms a dispersion.

The amount of polyethyleneimine can be suitably adjusted according to the kinds of the polyvalent isocyanate compound-containing polymerization component to be used, the molecular weight of polyethyleneimine to be used, etc., and is not particularly limited. In general, the amount of polyethyleneimine is preferably about 1 to about 20 mass %, and more preferably about 5 to about 15 mass %, relative to the polyvalent isocyanate compound-containing polymerization component used in the production of composite particles.

Further, the polymerization reaction of the polyvalent isocyanate compound-containing polymerization component is performed generally at about 30 to about 120° C., and preferably at about 60 to about 120° C. The reaction time may be generally within the range of 1 to 24 hours, and preferably within the range of 3 to 12 hours.

As for the mean particle diameter of composite particles used in the present invention, it is preferable that the volume mean particle diameter be about 0.1 to about 15 μm, more preferably about 0.3 to about 6.0 μm, and even more preferably about 0.5 to about 3.0 μm, considering coloring sensitivity. The mean particle diameter of composite particles may be controlled by adjusting the mean particle diameter of an emulsion obtained by emulsifying and dispersing in an aqueous medium a solution containing a dye precursor and a polyvalent isocyanate compound-containing polymerization component.

In general, the thus-obtained polymer reaction mixture is used as a composite particle dispersion directly or after dilution with water, without isolating the formed composite particles.

Developer

Developers used in the heat-sensitive recording material of the present invention are not limited, and known compounds can be used. Examples of such developers include 4,4'-isopropylidenediphenol, 4,4'-cyclohexylidenediphenol, 2,2-bis(4-hydroxyphenyl)-4-methylpentane, 2,4'-dihydroxydiphenylsulfone, 4,4'-dihydroxydiphenylsulfone, 4-hydroxy-4'-isopropoxydiphenylsulfone, 4-hydroxy-4'-allyloxydiphenylsulfone, 3,3'-diallyl-4,4'-dihydroxy diphenylsulfone, 4-hydroxy-4'-methyldiphenylsulfone, butyl bis(p-hydroxyphenyl)acetate, methyl bis(p-hydroxyphenyl) acetate, 1,1-bis(4-hydroxyphenyl)-1-phenylethane, 1,4-bis(α-methyl-α-(4'-hydroxyphenyl)ethyl)benzene, and like phenolic compounds; N-p-tolylsulfonyl-N'-phenylurea, 4,4'-bis(N-p-tolylsulfonylaminocarbonylamino)diphenylmethane, 4,4'-bis[(4-methyl-3-phenoxycarbonylaminophenyl)ureido]diphenylsulfone, N-p-tolylsulfonyl-N'-p-butoxyphenylurea, and like compounds having sulfonyl group(s) and ureido or ureylene group(s) per molecule; zinc 4-[2-(p-methoxyphenoxy)ethyloxy]salicylate, zinc 4-(3-(p-tolylsulfonyl)propyloxy)salicylate, zinc 5-(p-(2-p-methoxyphenoxyethoxy)cumyl)salicylate, and like zinc-salt compounds of aromatic carboxylic acid; etc. Of course, such developers can be used in combination, as necessary.

Using an aqueous solution containing polyacrylamide, polyvinylpyrrolidone, completely or partially saponified polyvinyl alcohol, sulfone modified polyvinyl alcohol, methylcellulose, carboxymethyl cellulose, hydroxypropyl methylcellulose, and like protective colloid agents, and optionally a surfactant and anti-foaming agent dissolved therein as a dispersion medium, the developer is pulverized by means of a sand mill, attritor, ball mill, co-ball mill, and like wet grinding mills to a mean particle diameter of 1 μm or less, preferably about 0.2 to about 0.5 μm. In place of the developer that is pulverized by milling, it is possible to use an emulsion of the developer prepared by using an appropriate organic solvent and an emulsifier.

Support

The material, shape and dimension of the support used in the present invention are not particularly limited. For example, the support may be suitably selected from wood-free paper (acid paper, neutralized paper), wood-containing paper, recycled mixed paper, coated paper, art paper, cast-coated paper, glassine paper, resin-laminated paper, polyolefin-based synthetic paper, synthetic fiber paper, nonwoven fabric, synthetic resin films such as polyethylene terephthalate films, polypropylene films, polyethylene films, etc. The synthetic resin film may be a transparent film, or a transparent film of blue or other color.

The thickness of the support is generally about 20 to about 200 μm.

Formation of Heat-Sensitive Recording Layer

In the heat-sensitive recording material of the present invention, the heat-sensitive recording layer is usually prepared by applying to a support a heat-sensitive recording layer coating composition that is obtained by mixing dye precursor-containing composite particles, a developer, a binder, and as necessary, a sensitizer for improving recording sensitivity, an image stabilizer for improving the preservability of the recording image, a pigment, and various auxiliaries using water as dispersion medium, followed by drying. In general, the use of the aforementioned composite particle dispersion is advantageous in the preparation of the heat-sensitive recording layer coating composition.

The heat-sensitive recording layer of the present invention basically contains the dye precursor in the form of the aforementioned composite particles. In the present invention, the proportion of the dye precursor and the developer is such that the amount of the developer is preferably about 100 to about 700 mass %, and more preferably about 150 to about 400 mass %, relative to the mass of the dye precursor present in the heat-sensitive recording layer. The amount of the developer is preferably about 10 to about 60 mass %, and more preferably about 15 to about 50 mass %, relative to the total solids of the heat-sensitive recording layer.

Examples of binders include water-soluble polymers such as completely or partially saponified polyvinyl alcohol, acetoacetyl-modified polyvinyl alcohol, carboxy-modified polyvinyl alcohol, diacetone-modified polyvinyl alcohol, and like various modified polyvinyl alcohols; starch and its derivatives; hydroxymethyl cellulose, hydroxyethyl cellulose, hydroxypropyl cellulose, methylcellulose, ethylcellulose, and like cellulose derivatives; sodium polyacrylate, polyvinyl pyrrolidone, acryl amide/acrylic ester copolymers, acrylamide/acrylic ester/methacrylic ester copolymers, styrene/maleic anhydride copolymers, iso-butylene/maleic anhydride copolymers, casein, gelatin and its derivatives, etc.; emulsions such as polyvinyl acetate, polyurethane, polyacrylic acid, polyacrylic ester, chloroethylene/vinyl acetate copolymers, poly butyl methacrylate, ethylene/vinyl acetate copolymers, etc.; latex of water-insoluble copolymers such as styrene/butadiene copolymers, styrene/butadiene/acrylic copolymers, etc.

It is preferable that the amount of the binder be within the range of about 5 to about 50 mass %, and preferably about 5 to about 30 mass %, relative to the total solids of the heat-sensitive recording layer.

Sensitizers may be any compounds conventionally known as sensitizers for heat-sensitive recording materials. Examples thereof include stearic acid amide, stearic acid methylol amide, stearic acid ethylene bisamide, oleic acid amide, palmitic acid amide, behenic acid amide, methylolated fatty acid amide, and like amide compounds; oxalic acid dibenzyl ester, oxalic acid di-p-methylbenzyl ester, oxalic acid di-p-chloro benzyl ester, terephthalic acid dimethyl ester, terephthalic acid dibenzyl ester, 1-hydroxy-2-naphthoic acid phenyl ester, 1,2-di(3-methylphenoxy)ethane, 1,2-di(4-methylphenoxy)ethane, 1,2-diphenoxyethane, 1-phenoxy-2-naphthoxy ethane, 1-phenoxy-2-(4-methylphenoxy)ethane, 1-(4-methylphenoxy)-2-naphthoxy ethane, 1,3-naphthoxy propane, 1,4-naphthoxy butane, p-benzylbiphenyl, m-terphenyl, benzyl-2-naphthyl ether, 1,2-bis(3,4-dimethylphenyl)ethane, 1,4-bis(p-tolyloxy)benzene, diphenylsulfone, diphenyl carbonate, 2-(2'-hydroxy-5'-methylphenyl)benzotriazole, 2-hydroxy-4-octoxybenzophenone, etc. Of the sensitizers, to maintain the good heat resistance of the white portion in particular, the mixture of oxalic acid di-p-methylbenzyl ester and oxalic acid di-p-chloro benzyl ester, 1-phenoxy-2-naphthoxy ethane, 1-(4-methylphenoxy)-2-naphthoxy ethane, or 2-(2'-hydroxy-5'-methylphenyl)benzotriazole is preferable. When any of such sensitizers is used, the amount thereof is generally about 0.1 to about 5 parts by mass, and particularly about 0.5 to about 3 parts by mass, per part by mass of the dye precursor.

Examples of image stabilizers include 1,1,3-tris(2-methyl-4-hydroxy-5-cyclohexylphenyl)butane, 1,1,3-tris(2-methyl-4-hydroxy-5-tert-buthylphenyl)butane, 1,1-bis(2-methyl-4-hydroxy-5-tert-buthylphenyl)butane, 4,4'-[1,4-phenylenebis(1-methylethylidene)]bisphenol, 4,4'-[1,3-phenylenebis(1-methylethylidene)]bisphenol, and like phenol-based compounds; 4-benzyloxyphenyl-4'-(2-methyl-2,3-epoxy propyloxy)phenylsulfone, 4-(2-methyl-1,2-epoxy ethyl) diphenylsulfone, 4-(2-ethyl-1,2-epoxy ethyl)diphenylsulfone, and like epoxy compounds; 1,3,5-tris(2,6-dimethylbenzyl-3-hydroxy-4-tert-butyl)isocyanuric acid, and like isocyanuric acid compounds; etc. When any of such image stabilizers is used, the amount thereof is generally about 0.1 to about 1 part by mass, and particularly about 0.2 to about 0.7 parts by mass, per part by mass of the dye precursor.

Similar to the aforementioned developers, sensitizers and image stabilizers may be either pulverized by wet grinding, or formed into an emulsion, and then mixed during the preparation of a heat-sensitive recording layer coating composition.

Examples of pigments include inorganic pigments such as calcium carbonate, magnesium carbonate, kaolin, clay, talc, calcined clay, silica, diatomite, synthetic aluminum silicate, zinc oxide, titanium oxide, aluminum hydroxide, barium sulfate, surface-treated calcium carbonate, surface-treated silica, etc.; and organic pigments such as urea-formalin resins, styrene-methacrylic acid copolymer resins, polystyrene resins, etc. To prevent residue adhesion on a thermal head and sticking, pigment having an oil absorption of 50 ml/100 g or more is preferably used. In general, the pigment has an mean particle diameter of 10 μm or less. The amount of the pigment, when used, is preferably such that the color density is not lowered, i.e., 50 mass % or less, and particularly about 5 to about 30 mass %, relative to the total solids of the heat-sensitive recording layer.

As necessary, various auxiliaries such as cross-linking agents (water-resisting agents), waxes, and metallic soaps, as well as oil repellents, anti-foaming agents, viscosity adjusting agents, etc. can be added to a heat-sensitive recording layer coating composition.

Examples of such cross-linking agents include aldehyde-based compounds such as glyoxal etc., polyamine-based compounds such as polyethyleneimine etc., epoxy compounds, polyamide resins, melamine resins, dimethylol urea compounds, aziridine compounds, block isocyanate compounds, boric acids, boric acid triesters, boron-based polymers, etc. When any of such cross-linking agents is used, the amount thereof is preferably about 0.1 to about 10 mass %, and more preferably about 0.3 to about 5 mass %, relative to the total solids of the heat-sensitive recording layer.

Examples of waxes include paraffin wax, carnauba wax, microcrystalline wax, polyolefin wax, and polyethylene wax, as well as higher fatty acid esters, and the derivatives thereof.

Examples of metallic soaps include higher fatty acid polyvalent metallic salts, e.g., zinc stearate, aluminum stearate, calcium stearate, zinc oleate, etc.

Methods for forming a heat-sensitive recording layer on a support are not particularly limited, and known methods for coating such as air-knife coating, blade coating, gravure coating, roll coating, spray coating, dip coating, bar coating, curtain coating and extrusion coating can be employed. Further, the heat-sensitive recording layer coating composition of the present invention may be partially printed using a printer, etc. The heat-sensitive recording layer coating composition is applied to one surface of the support in an amount generally about 1 to about 30 g/m$^2$, and preferably about 3 to about 25 g/m$^2$, on a dry weight basis, to thereby form a heat-sensitive recording layer. A back coat layer may be provided to reduce the permeation of oil or a plasticizer from the back surface of the recording material, or to control curling. Smoothing treatment on a heat-sensitive recording layer using a super calender, a soft calender or like known smoothing method can enhance the coloring sensitivity. In this case, the surface of the heat-sensitive recording layer may be brought into contact with either a metal roll or an elastic roll of a calender.

In the present invention, the heat-sensitive recording material is subjected to further processes to provide better functions for value-added purposes. For example, by applying an adhesive, remoistening adhesive, delayed-tack adhesive, or the like on the back surface, the heat-sensitive recording material may be used as an adhesive paper, remoistening adhesive paper, and delayed-tack paper. Further, by performing a magnetic process, a heat-sensitive recording material having a layer capable of magnetic recording on the back surface may be formed. Additionally, the heat-sensitive recording material may be arranged, at the back surface thereof, to function as a thermal transfer paper, ink-jet printing paper, no-carbon paper, electrostatic recording paper, and xerography paper. Thereby, a recording material capable of double-sided recording may be produced. The recoding material of the invention can obviously be prepared as a double-sided heat-sensitive recording material.

In the present invention, a protective layer can be provided on a heat-sensitive recording layer, and an undercoat layer can be provided between the heat-sensitive recording layer and a support. The protective layer and the undercoat layer may comprise a pigment and a binder as main components.

Usable examples of binders contained in the protective layer include completely saponified polyvinyl alcohols, acetoacetyl-modified polyvinyl alcohols, carboxy-modified polyvinyl alcohols, silicon-modified polyvinyl alcohols, diacetone-modified polyvinyl alcohols, and like polyvinyl alcohols; ionomeric urethane-based resin latex, styrene-butadiene resin latex, and like resin latexes. Examples of usable pigments contained in the protective layer include inorganic pigments such as calcined kaolin, kaolin, aluminum hydroxide, amorphous silica, etc., as well as organic pigments such as a poly(meth)acrylic ester-based resin. The amount of the pigment is preferably about 5 to about 65 mass %, particularly preferably about 15 to about 50 mass % relative to the total solids of the protective layer. In particular, it is preferable to add lubricants such as a polyolefin wax and zinc stearate to the protective layer for preventing sticking to the thermal head. The protective layer may have a structure of at least two layers. Provision of a glosses protective layer can improve the added value of the product. The protective layer is formed by homogeneously mixing the binder, pigment, and if necessary, lubricant, with water to form an aqueous protective layer coating composition, then applying the protective layer coating composition to the heat-sensitive recording layer, followed by drying. The protective layer coating composition is applied generally in an amount about 0.5 to about 10 g/m$^2$, and preferably about 1 to about 6 g/m$^2$, on a dry weight basis.

A protective layer containing a UV-curable resin or EB-curable resin can be provided on the heat-sensitive recording layer of the present invention, and printing with UV ink or flexographic ink can be provided on the protective layer. The heat-sensitive recording material of the present invention can also be used as a linerless adhesive label by the use of a mold lubricant such as silicone in the protective layer. In this case, a mold lubricant may be applied after printing. The coloring sensitivity of the heat-sensitive recording layer formed on an undercoat layer can be improved by the use of pigments with a high porosity, e.g., silica, calcined kaolin, etc. in the undercoat layer. Further, it is preferable to include a plastic pigment, hollow particles, foam, etc. in the undercoat layer, since the effect of improving coloring sensitivity of the heat-sensitive recording layer formed thereon can be exhibited.

In order to apply each of the layers to the support, any known coating technique such as air-knife coating, blade coating, gravure coating, roll coating, spray coating, dip coating, bar coating, curtain coating, extrusion coating, etc. can be used.

EXAMPLES

The present invention is described in more detail with reference to the following examples; however, the present invention is not limited thereto. In the examples, "parts" and "%" represent "parts by mass" and "% by mass", respectively, unless otherwise specified.

The mean particle diameter of composite particles and the mean particle diameter of pigments used in the protective layer are the volume mean particle diameters measured using a laser diffraction particle size analyzer SALD-2200 (manufactured by Shimadzu Corporation).

Moreover, the mean particle diameter of a developer is the value measured using a dynamic light-scattering particle size analyzer LB-500 (manufactured by Horiba, Ltd.).

Example 1

Preparation of Dye Precursor-Containing Composite Particle Dispersion (Liquid A)

As a dye precursor, 20 parts of 3-di(n-butyl)amino-6-methyl-7-anilinofluoran was dissolved in 24 parts of dicyclohexylmethane-4,4'-diisocyanate (trade name: Desmodur (registered trademark) W; manufactured by Sumika Bayer Urethane Co., Ltd.) heated at 150° C. This solution was gradually added to 200 parts of a 6% aqueous solution of polyvinyl alcohol (trade name: Poval (registered trademark) PVA217EE; manufactured by Kuraray Co., Ltd.), and emulsified and dispersed for 2 minutes by stirring at 7,000 rpm using a homogenizer (trade name: T. K. ROBO MICS; manufactured by Tokushu Kika Kogyo Co., Ltd.). The resulting emulsion was heated to 90° C., and 20 parts of a 10% aqueous solution of polyethyleneimine having a branched structure containing primary, secondary, and tertiary amines, and having a molecular weight of 300 (trade name: Epomin (registered trademark) SP-003; manufactured by Nippon Shokubai Co., Ltd.) was added as a reaction accelerator, followed by a polymerization reaction for 10 hours. Thus, a dispersion of dye precursor-containing composite particles having a mean particle diameter of 1.0 μm (Liquid A) was prepared. The solids content of the composite particle dispersion was 30%.

Preparation of Developer Dispersion (Liquid B)

A composition composed of 20 parts of 3,3'-diallyl-4,4'-dihydroxydiphenylsulfone, 20 parts of a 10% aqueous solution of sulfone-modified polyvinyl alcohol, and 40 parts of water was pulverized using an Ultravisco mill to a mean particle diameter of 0.3 μm, thus producing a developer dispersion (Liquid B).

Preparation of Heat-Sensitive Recording Layer Coating Composition

A composition composed of 150 parts of Liquid A, 300 parts of Liquid B, 50 parts of a 60% aqueous dispersion of calcium carbonate, 100 parts of a 10% aqueous solution of polyvinyl alcohol (trade name: Poval (registered trademark) PVA117; manufactured by Kuraray Co., Ltd.), 20 parts of a 30% dispersion of zinc stearate, and 50 parts of water was agitated, thus producing a heat-sensitive recording layer coating composition.

Production of Heat-Sensitive Recording Material

The heat-sensitive recording layer coating composition obtained above was applied to one side of acid paper weighing 53 g/m$^2$ using a Mayer bar so that the coating amount after drying was 7 g/m$^2$, and dried, followed by supercalender treatment. Thus, a heat-sensitive recording material was obtained.

Example 2

A heat-sensitive recording material was obtained in the same manner as in Example 1 except that in the preparation of Liquid A, 20 parts of a 10% aqueous solution of polyethyleneimine having a branched structure containing primary, secondary, and tertiary amines, and having a molecular weight of 600 (trade name: Epomin (registered trademark) SP-006; manufactured by Nippon Shokubai Co., Ltd.) was used as a reaction accelerator in place of 20 parts of the 10% aqueous solution of polyethyleneimine having a branched structure containing primary, secondary, and tertiary amines, and having a molecular weight of 300 (trade name: Epomin (registered trademark) SP-003; manufactured by Nippon Shokubai Co., Ltd.). The mean particle diameter of the composite particles at this time was 1.0 μm.

Example 3

A heat-sensitive recording material was obtained in the same manner as in Example 1 except that in the preparation of Liquid A, 20 parts of a 10% aqueous solution of polyethyleneimine having a branched structure containing primary, secondary, and tertiary amines, and having a molecular weight of 1,200 (trade name: Epomin (registered trademark) SP-012; manufactured by Nippon Shokubai Co., Ltd.) was used as a reaction accelerator in place of 20 parts of the 10% aqueous solution of polyethyleneimine having a branched structure containing primary, secondary, and tertiary amines, and having a molecular weight of 300 (trade name: Epomin (registered trademark) SP-003; manufactured by Nippon Shokubai Co., Ltd.). The mean particle diameter of the composite particles at this time was 1.0 μm.

Example 4

A heat-sensitive recording material was obtained in the same manner as in Example 1 except that in the preparation of Liquid A, the amount of dicyclohexylmethane-4,4'-diisocyanate was reduced from 24 parts to 18 parts. The mean particle diameter of the composite particles at this time was 1.4 μm.

Example 5

A heat-sensitive recording material was obtained in the same manner as in Example 2 except that in the preparation of Liquid A, 12 parts of dicyclohexylmethane-4,4'-diisocyanate (trade name: Desmodur (registered trademark) W; manufactured by Sumika Bayer Urethane Co., Ltd.) and 12 parts of m-tetramethylxylylene diisocyanate (trade name: TMXDI (registered trademark) (META); manufactured by Nihon Cytec Industries Inc.) were used in place of 24 parts of dicyclohexylmethane-4,4'-diisocyanate (trade name: Desmodur (registered trademark) W; manufactured by Sumika Bayer Urethane Co., Ltd.). The mean particle diameter of the composite particles at this time was 1.0 μm.

Comparative Example 1

A heat-sensitive recording material was obtained in the same manner as in Example 1 except that in the preparation of Liquid A, no reaction accelerator was used in the polymerization reaction of the polyvalent isocyanate compound-containing polymerization component. The mean particle diameter of the composite particles at this time was 1.3 μm.

Comparative Example 2

A heat-sensitive recording material was obtained in the same manner as in Example 1 except that in the preparation of Liquid A, 20 parts of a 10% aqueous solution of modified aliphatic polyamine containing diethylenetriamine as a main component (trade name: Epicure (registered trademark) T; manufactured by Japan Epoxy Resins Co., Ltd.) was used as a reaction accelerator in place of 20 parts of the 10% aqueous solution of polyethyleneimine having a branched structure containing primary, secondary and tertiary amines, and having a molecular weight of 300 (trade name: Epomin (registered trademark) SP-003; manufactured by Nippon Shokubai Co., Ltd.). The mean particle diameter of the composite particles at this time was 1.0 μm.

Comparative Example 3

The heat-sensitive recording material was obtained in the same manner as in Example 1 except that in the preparation of Liquid A, 20 parts of a 10% aqueous solution of modified aliphatic polyamine containing diethylenetriamine as a main component (trade name: Epicure (registered trademark) T; manufactured by Japan Epoxy Resins Co., Ltd.) was used as a reaction accelerator in place of 20 parts of the 10% aqueous solution of polyethyleneimine having a polyethyleneimine containing primary, secondary, and tertiary amines, and having a molecular weight of 300 (trade name: Epomin (registered trademark) SP-003; manufactured by Nippon Shokubai Co., Ltd.), and that the amount of dicyclohexylmethane-4,4'-diisocyanate was reduced from 24 parts to 18 parts. The mean particle diameter of the composite particles at this time was 1.3 μm.

Comparative Example 4

A heat-sensitive recording material was obtained in the same manner as in Example 1 except that in the preparation of Liquid A, 20 parts of a 10% aqueous solution of polyethyleneimine having a branched structure containing primary, secondary, and tertiary amines, and having a molecular weight of 1,800 (trade name: Epomin (registered trademark) SP-018; manufactured by Nippon Shokubai Co., Ltd.) was used as a reaction accelerator in place of 20 parts of the 10% aqueous solution of polyethyleneimine having a branched structure containing primary, secondary, and tertiary amines, and having a molecular weight of 300 (trade name: Epomin (registered trademark) SP-003; manufactured by Nippon Shokubai Co., Ltd.). The mean particle diameter of the composite particles at this time was 1.0 μm.

The heat-sensitive recording materials obtained above were evaluated for the following properties. Table 1 shows the results.

Recording Density

A heat-sensitive recording tester (TH-PMD; manufactured by Ohkura Electric Co., Ltd.) was used to record on each heat-sensitive recording material with a low applied energy of 0.3 mJ/dot and a high applied energy of 0.8 mJ/dot, and the densities of the obtained recorded image portion and unrecorded portion were measured with a Macbeth RD918 densitometer (in visual mode; manufactured by GretagMacbeth).

Heat Resistance

After treating each heat-sensitive recording material in a blank state at 100° C. for 24 hours, the density of the unrecorded portion was measured again with a Macbeth densitometer to evaluate background fogging generated upon exposure to a high-temperature environment. Simultaneously, the degree of background fogging was visually evaluated in accordance with the following criteria: no problem=O; background fogging was recognized even when the recording material was evaluated independently=X; and background fogging was recognized when the recording material was compared to one before the test=Δ.

TABLE 1

| | Density in unrecorded portion | Density in recorded portion 0.3 mJ/dot | Density in recorded portion 0.8 mJ/dot | Density in unrecorded portion after heat resistance test | Visual evaluation after heat resistance test |
|---|---|---|---|---|---|
| Ex. 1 | 0.06 | 0.55 | 1.24 | 0.10 | ○ |
| Ex. 2 | 0.06 | 0.52 | 1.23 | 0.09 | ○ |
| Ex. 3 | 0.05 | 0.45 | 1.24 | 0.08 | ○ |
| Ex. 4 | 0.08 | 0.82 | 1.32 | 0.11 | ○ |
| Ex. 5 | 0.06 | 0.58 | 1.25 | 0.09 | ○ |
| Comp. Ex. 1 | 0.24 | 0.82 | 1.33 | 1.14 | X |
| Comp. Ex. 2 | 0.08 | 0.41 | 1.21 | 0.23 | Δ |
| Comp. Ex. 3 | 0.18 | 0.53 | 1.33 | 0.52 | X |
| Comp. Ex. 4 | 0.05 | 0.28 | 1.16 | 0.07 | ○ |

Example 6

Preparation of Dye Precursor-Containing Composite Particle Dispersion (Liquid C)

As a dye precursor, 15 parts of 3-(N-ethyl-N-isoamylamino)-6-methyl-7-anilinofluoran, 5 parts of 3-diethylamino-6,8-dimethylfluoran, and 5 parts of 3,3'-bis(4-diethylamino-2-ethoxyphenyl)-4-azaphthalide were dissolved in 20 parts of dicyclohexylmethane-4,4'-diisocyanate (trade name: Desmodur (registered trademark) W; manufactured by Sumika Bayer Urethane Co., Ltd.) heated at 150° C. This solution was gradually added to 100 parts of a 10% aqueous solution of polyvinyl alcohol (trade name: Poval (registered trademark) PVA217EE; manufactured by Kuraray Co., Ltd.), and emulsified and dispersed for 3 minutes by stirring at 9,500 rpm using a homogenizer (trade name: T.K. ROBO MICS; manufactured by Tokushu Kika Kogyo Co., Ltd.). The emulsion was heated to 90° C., and 15 parts of a 10% aqueous solution of polyethyleneimine having a branched structure containing primary, secondary, and tertiary amines, and having a molecular weight of 300 (trade name: Epomin (registered trademark) SP-003; manufactured by Nippon Shokubai Co., Ltd.) was added as an accelerator, followed by a polymerization reaction for 10 hours. Thus, a dispersion of dye precursor-containing composite particles having a mean particle diameter of 1.0 μm (Liquid C) was prepared. The solids content of the composite particle dispersion was 30%.

Preparation of Developer Dispersion (Liquid D)

A composition composed of 20 parts of 4,4'-cyclohexylidenediphenol, 20 parts of a 10% aqueous solution of partially saponified polyvinyl alcohol, and 40 parts of water was pulverized to a mean particle diameter of 0.3 μm using an Ultravisco mill, thus producing a developer dispersion (Liquid D).

Preparation of Heat-Sensitive Recording Layer Coating Composition

A composition composed of 100 parts of Liquid C, 70 parts of Liquid D, 70 parts of a 30% dispersion of stearic acid amide, 46 parts of a styrene-butadiene-based latex (trade name: Smartex (registered trademark) PA-9280; manufactured by Nippon A&L Inc., solids content: 48%), and 30 parts of water was agitated, thus producing a heat-sensitive recording layer coating composition.

Preparation of Protective Layer Coating Composition

A composition composed of 100 parts of an ionomeric urethane-based resin latex (trade name: Hydran (registered trademark) AP-30F; manufactured by Dainippon Ink & Chemicals Inc., solids content: 20%), 500 parts of a 8% aqueous solution of acetoacetyl-modified polyvinyl alcohol (trade name: Gohsefimer (registered trademark) Z-410, degree of polymerization: about 2,300, degree of saponification: about 98 mol %; manufactured by Nippon Synthetic Chemical Industry Co., Ltd.), 50 parts of a 60% slurry obtained by pulverizing kaolin (trade name: ULTRA WHITE (registered trademark) 90; manufactured by BASF A.G.) to a mean particle diameter of 1.6 μm, 2 parts of a 40% slurry of calcined kaolin (trade name: ANSILEX (registered trademark) 93; manufactured by BASF A.G.) having a mean particle diameter of 2.5 μm, 26 parts of stearic acid amide (trade name: Hymicron L-271; manufactured by Chukyo Yushi Co., Ltd., solids content: 25%), 4 parts of potassium stearyl phosphate (trade name: Woopol 1800; manufactured by Matsumoto Yushi-Seiyaku, solids content: 35%), 15 parts of a 10% aqueous solution of a perfluoroalkyl ethylene oxide adduct (trade name: Surflon (registered trademark) S-145; manufactured by Seimi Chemical, Co., Ltd.), and 300 parts of water was agitated, thus producing a protective layer coating composition.

Production of Heat-Sensitive Recording Material

The heat-sensitive recording layer coating composition and protective layer coating composition were applied on one side of a blue transparent polyethylene terephthalate film (trade name: Melinex (registered trademark) 912, thickness: 175 μm; manufactured by Teijin DuPont) in this order from the support side using a slot-die coater so that the coating amounts of the heat-sensitive recording layer coating composition and protective layer coating composition after drying were 20 g/m$^2$ and 3.5 g/m$^2$, respectively, and dried, individually by layer. Thus, a heat-sensitive recording material was obtained.

Example 7

A heat-sensitive recording material was obtained in the same manner as in Example 6 except that in the preparation of Liquid C, 15 parts of a 10% aqueous solution of polyethyleneimine having a branched structure containing primary, secondary, and tertiary amines, and having a molecular weight of 600 (trade name: Epomin (registered trademark) SP-006; manufactured by Nippon Shokubai Co., Ltd.) was used as a reaction accelerator in place of 15 parts of the 10% aqueous solution of polyethyleneimine having a branched structure containing primary, secondary, and tertiary amines, and having a molecular weight of 300 (trade name: Epomin (registered trademark) SP-003; manufactured by Nippon Shokubai Co., Ltd.). The mean particle diameter of the composite particles at this time was 1.0 μm.

Example 8

A heat-sensitive recording material was obtained in the same manner as in Example 6 except that in the preparation of Liquid C, 15 parts of a 10% aqueous solution of polyethyleneimine having a branched structure containing primary, secondary, and tertiary amines, and having a molecular weight of 1,200 (trade name: Epomin (registered trademark) SP-012; manufactured by Nippon Shokubai Co., Ltd.) was used as a reaction accelerator in place of 15 parts of the 10% aqueous solution of polyethyleneimine having a branched structure containing primary, secondary, and tertiary amines, and having a molecular weight of 300 (trade name: Epomin (registered trademark) SP-003; manufactured by Nippon Shokubai Co., Ltd.). The mean particle diameter of the composite particles at this time was 1.0 μm.

Example 9

A heat-sensitive recording material was obtained in the same manner as in Example 7 except that in the preparation of Liquid C, 10 parts of dicyclohexylmethane-4,4'-diisocyanate (trade name: Desmodur (registered trademark) W; manufactured by Sumika Bayer Urethane Co., Ltd.) and 10 parts of m-tetramethylxylylene diisocyanates (trade name: TMXDI (registered trademark) (META); manufactured by Nihon Cytec Industries Inc.) were used in place of 20 parts of dicyclohexylmethane-4,4'-diisocyanate (trade name: Desmodur (registered trademark) W; manufactured by Sumika Bayer Urethane Co., Ltd.). The mean particle diameter of the composite particles at this time was 1.0 μm.

Example 10

A heat-sensitive recording material was obtained in the same manner as in Example 7 except that in the preparation of Liquid C, 15 parts of m-tetramethylxylylene diisocyanate (trade name: TMXDI (registered trademark) (META); manufactured by Nihon Cytec Industries Inc.) and 5 parts of an isocyanurate of hexamethylene diisocyanate (trade name: Takenate (registered trademark) D170HN; manufactured by Mitsui Takeda Chemicals) were used in place of 20 parts of dicyclohexylmethane-4,4'-diisocyanate (trade name: Desmodur (registered trademark) W; manufactured by Sumika Bayer Urethane Co., Ltd.). The mean particle diameter of the composite particles at this time was 1.0 μm.

Comparative Example 5

A heat-sensitive recording material was obtained in the same manner as in Example 6 except that in the preparation of Liquid C, no reaction accelerator was used during the polymerization reaction of the polyvalent isocyanate compound. The mean particle diameter of the composite particles at this time was 1.3 μm.

Comparative Example 6

A heat-sensitive recording material was obtained in the same manner as in Example 6 except that in the preparation of Liquid C, 15 parts of a 10% aqueous solution of modified aliphatic polyamine containing diethylenetriamine as a main component (trade name: Epicure (registered trademark) T; manufactured by Japan Epoxy Resins Co., Ltd.) was used as a reaction accelerator in place of 15 parts of the 10% aqueous solution of polyethyleneimine having a branched structure containing primary, secondary, and tertiary amines, and having a molecular weight of 300 (trade name: EPOMIN (registered trademark) SP-003; manufactured by Nippon Shokubai Co., Ltd.). The mean particle diameter of the composite particles at this time was 1.0 μm.

Comparative Example 7

A heat-sensitive recording material was obtained in the same manner as in Example 6 except that in the preparation of Liquid C, 15 parts of a 10% aqueous solution of polyethyleneimine having a branched structure containing primary, secondary, and tertiary amines, and having a molecular weight of 1,800 (trade name: Epomin (registered trademark) SP-018; manufactured by Nippon Shokubai Co., Ltd.) was used as a reaction accelerator in place of 15 parts of the 10% aqueous solution of polyethyleneimine having a branched structure containing primary, secondary, and tertiary amines, and having a molecular weight of 300 (trade name: Epomin (registered trademark) SP-003; manufactured by Nippon Shokubai Co., Ltd.). The mean particle diameter of the composite particles at this time was 1.0 μm.

The heat-sensitive recording materials obtained above were evaluated for the following properties. Table 2 shows the results.

Recording Sensitivity

A heat-sensitive printing tester (model name: TH-PMH; manufactured by Ohkura Electric Co., Ltd.) was used to perform printing on each heat-sensitive recording material under each energy condition, and the densities of the obtained recorded image portion and unrecorded portion were measured with a Macbeth TR-927 densitometer (in visual mode; manufactured by GretagMacbeth).

Heat Resistance

After treating each heat-sensitive recording material in a blank state at 70° C. for 2 hours, the density of the unrecorded portion was measured again with a Macbeth densitometer to evaluate background fogging generated upon exposure to a high-temperature environment. Simultaneously, the degree of background fogging was visually evaluated in accordance with the following criteria: no problem=O; background fogging was recognized even when the recording material was evaluated independently=X; and background fogging was recognized when the recording material was compared to one before the test=Δ.

TABLE 2

| | Density in unrecorded portion | Density in recorded portion 0.56 mJ/dot | 0.65 mJ/dot | 0.70 mJ/dot | 0.81 mJ/dot | Density in unrecorded portion after heat resistance test | Visual evaluation after heat resistance test |
|---|---|---|---|---|---|---|---|
| Ex. 6 | 0.16 | 0.22 | 0.96 | 1.83 | 2.53 | 0.17 | ○ |
| Ex. 7 | 0.15 | 0.20 | 0.88 | 1.72 | 2.45 | 0.16 | ○ |
| Ex. 8 | 0.15 | 0.19 | 0.77 | 1.63 | 2.34 | 0.15 | ○ |
| Ex. 9 | 0.16 | 0.22 | 0.97 | 1.85 | 2.57 | 0.18 | ○ |
| Ex. 10 | 0.16 | 0.23 | 1.08 | 1.95 | 2.65 | 0.18 | ○ |
| Comp. Ex. 5 | 0.20 | 0.50 | 1.11 | 1.96 | 2.65 | 0.48 | X |
| Comp. Ex. 6 | 0.17 | 0.25 | 0.83 | 1.70 | 2.42 | 0.26 | X |
| Comp. Ex. 7 | 0.15 | 0.17 | 0.51 | 1.42 | 2.14 | 0.14 | ○ |

INDUSTRIAL APPLICABILITY

As is clear from the results shown in Tables 1 and 2, the heat-sensitive recording material of the present invention using dye precursor-containing composite particles, which are obtained by carrying out a polymerization reaction of a polyvalent isocyanate compound-containing polymerization component in the presence of polyethyleneimine having a specific molecular weight, undergoes a very small degree of background fogging, and even after exposure to a high-temperature environment, undergoes a very small degree of background fogging and exhibits excellent recording sensitivity. The heat-sensitive recording material is thus applicable as those for use in a high-temperature environment.

The invention claimed is:

1. A heat-sensitive recording material comprising a support and a heat-sensitive recording layer formed on the support, the heat-sensitive recording layer containing dye precursor-containing composite particles and a developer, the dye precursor-containing composite particles being obtained by dissolving a solute comprising a dye precursor in a solvent comprising a polyvalent isocyanate compound-containing polymerization component, emulsifying and dispersing the obtained solution in an aqueous medium, and then performing a polymerization reaction of the polyvalent isocyanate compound-containing polymerization component in the presence of polyethyleneimine having a molecular weight of 200 to 1,500.

2. The heat-sensitive recording material according to claim 1, wherein the polyethyleneimine has a molecular weight of 200 to 1,300.

3. The heat-sensitive recording material according to claim 1 or 2, wherein the polyethyleneimine has a branched structure containing primary, secondary, and tertiary amines.

4. The heat-sensitive recording material according to claim 1 or 2, wherein the polyethyleneimine is used in an amount of 1 to 20 mass % based on the polyvalent isocyanate compound-containing containing polymerization component.

5. The heat-sensitive recording material according to claim 1 or 2, wherein the polyvalent isocyanate compound-containing polymerization component is dicyclohexylmethane-4,4'-diisocyanate.

6. The heat-sensitive recording material according to claim 1 or 2, wherein the polyvalent isocyanate compound-containing polymerization component is dicyclohexylmethane-4,4'-diisocyanate and m-tetramethylxylylene diisocyanate.

7. The heat-sensitive recording material according to claim 1 or 2, wherein the polyvalent isocyanate compound-containing polymerization component is an isocyanurate of hexamethylene diisocyanate, and m-tetramethylxylylene diisocyanate.

8. The heat-sensitive recording material according to claim 1 or 2, further comprising a protective layer on the heat-sensitive recording layer.

9. A method of producing a heat-sensitive recording material, comprising the steps of:

(a) producing dye precursor-containing composite particles by dissolving a solute comprising a dye precursor in a solvent comprising a polyvalent isocyanate compound-containing polymerization component, emulsifying and dispersing the obtained solution in an aqueous medium, and then performing a polymerization reaction of the polyvalent isocyanate compound-containing polymerization component in the presence of polyethyleneimine having a molecular weight of 200 to 1,500;

(b) preparing a heat-sensitive recording layer coating composition comprising the obtained dye precursor-containing composite particles, a developer, and a binder; and (c) applying the obtained heat-sensitive recording layer coating composition to a support and drying the resulting coating.

10. The method according to claim 9, wherein the polyethyleneimine has a molecular weight of 200 to 1,300.

11. The method according to claim 9 or 10, wherein the polyethyleneimine has a branched structure containing primary, secondary, and tertiary amines.

12. The method according to claim 9 or 10, wherein the polyethyleneimine is used in an amount of 1 to 20 mass % based on the polyvalent isocyanate compound-containing polymerization component.

13. The method according to claim 9 or 10, wherein the polyvalent isocyanate compound-containing polymerization component is dicyclohexylmethane-4,4'-diisocyanate.

14. The method according to claim 9 or 10, wherein the polyvalent isocyanate compound-containing polymerization component is dicyclohexylmethane-4,4'-diisocyanate and m-tetramethylxylylene diisocyanate.

15. The method according to claim 9 or 10, wherein the polyvalent isocyanate compound-containing polymerization component is an isocyanurate of hexamethylene diisocyanate, and m-tetramethylxylylene diisocyanate.

* * * * *